US006325153B1

(12) United States Patent
Harrell

(10) Patent No.: US 6,325,153 B1
(45) Date of Patent: Dec. 4, 2001

(54) MULTI-VALVE FLUID FLOW CONTROL SYSTEM AND METHOD

(75) Inventor: John Woodrow Harrell, Waxahachie, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/469,667

(22) Filed: Dec. 22, 1999

Related U.S. Application Data

(60) Provisional application No. 60/114,784, filed on Jan. 5, 1999.

(51) Int. Cl.[7] ..... E21B 34/08

(52) U.S. Cl. ..... 166/386; 166/373; 166/383; 166/324; 166/332.7; 166/66.7

(58) Field of Search ..... 166/373, 369, 166/383, 386, 324, 332.7, 66.6, 66.7, 53

(56) References Cited

U.S. PATENT DOCUMENTS

| | | | |
|---|---|---|---|
| 3,905,575 | 9/1975 | Zeuner et al. . | |
| 4,100,937 | 7/1978 | Mallory . | |
| 4,111,226 | 9/1978 | Cameron . | |
| 4,437,385 | 3/1984 | Kramer et al. . | |
| 4,646,622 | 3/1987 | Ishizaki et al. . | |
| 4,796,708 * | 1/1989 | Lembcke | 166/386 |
| 4,901,798 * | 2/1990 | Amani | 166/311 |
| 5,076,144 | 12/1991 | Karakama et al. . | |
| 5,186,255 | 2/1993 | Corey | 166/250 |
| 5,261,454 | 11/1993 | Pavlica et al. . | |
| 5,597,042 * | 1/1997 | Tubel et al. | 166/250.01 |
| 5,645,263 | 7/1997 | Aardema . | |
| 5,906,238 * | 5/1999 | Carmody et al. | 166/53 |
| 5,979,558 | 11/1999 | Bouldin et al. | 166/363 |

FOREIGN PATENT DOCUMENTS

WO 97/37102 4/1997 (WO) .

* cited by examiner

*Primary Examiner*—David Bagnell
*Assistant Examiner*—Zakiya Walker
(74) *Attorney, Agent, or Firm*—Paul I. Herman; Warren B. Kice

(57) ABSTRACT

A system and method for controlling production fluid flow from a chamber extending between a casing disposed in a downhole bore and tubing disposed in the casing. A plurality of valves are disposed in respective openings formed in the tubing, and a passage is formed in each valve for connecting the chamber and the tubing interior. The valves are selectively closed to prevent any fluid flow through the passage, and selectively opened to permit fluid flow from the chamber, through the passage, and into the interior of the tubing. Thus, the volume of fluid passing from the chamber, through the valve members, and to the interior of the tubing is controlled.

12 Claims, 5 Drawing Sheets

MULTI-VALVE FLUID FLOW CONTROL SYSTEM AND METHOD

This application claims priority based on U.S. Provisional Application No. 60/114,784, filed on Jan. 5, 1999.

BACKGROUND

This disclosure relates generally to a control system and method for controlling the flow of oil and gas from a well bore casing to a production tubing and, more particularly, to such a system and method utilizing a plurality of valves for controlling the oil and gas flow.

In oil production installations, a well bore annulus, or casing, lines the well bore. Oil and gas (hereinafter "production fluid") present in an underground oil reservoir flows into the casing through perforations in the casing. Production tubing for transporting the production fluid from the reservoir level is disposed in the casing and extends upwards to the ground surface.

A valve is often used to control production fluid flow from inside the casing to the production tubing. One type of conventional valve uses a sliding sleeve valve, or choke, that utilizes a slotted sleeve which axially slides over a slotted port. However, a single choke valve does not allow for any incremental control of the production fluid flow. Furthermore, the linearly sliding choke occupies a relatively large space, which can be a major disadvantage since the casing interiors are relatively narrow, thus requiring greater valve lengths, and thus more material to manufacture the valve.

Another valve design uses an electro-hydraulic control system to open or close a valve, and a solenoid to control a hydraulic line. However, this design also does not allow for incremental production fluid flow control, utilizes a relatively large amount of electrical power, and is also relatively bulky.

Therefore, what is needed is a system of the above type that provides incremental control over the fluid flow, yet is simple, inexpensive, and relatively small in size.

SUMMARY

Therefore the system and method according to an embodiment of the present invention controls production fluid flow from a chamber extending between a casing disposed in a downhole bore and tubing disposed in the casing. A plurality of valves are disposed in respective openings formed in the tubing, and a passage is formed in each valve for connecting the chamber and the tubing interior. The valves are selectively closed to prevent any fluid flow through the passage, and selectively opened to permit fluid flow from the chamber, through the passage, and into the interior of the tubing. Thus, the volume of fluid passing from the chamber, through the valve members, and to the interior of the tubing is controlled.

The system of the above embodiment provides incremental control over the amount of fluid flow, yet is simple, inexpensive, and relatively small in size, while requiring minimal electrical power.

DETAILED DESCRIPTION

Figure 1:
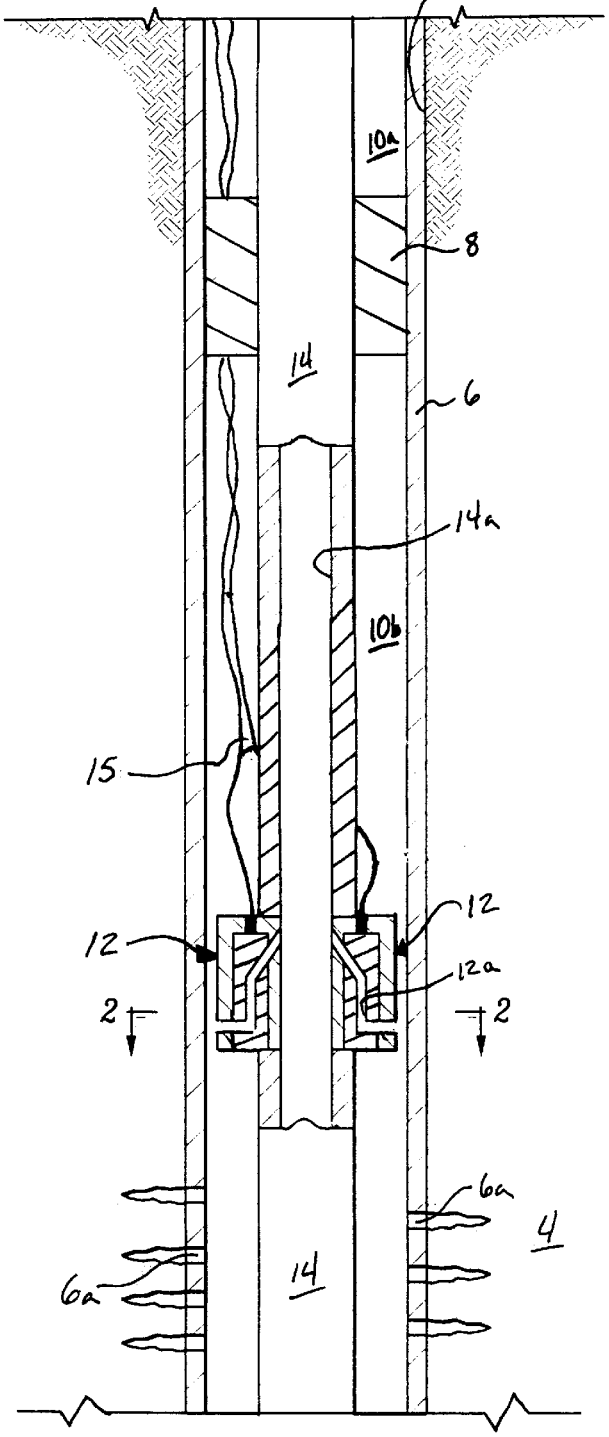
FIG. 1 is a sectional view of a downhole bore production fluid recovery system incorporating the multi-valve fluid control system according to an embodiment of the present invention.
Figure 2:
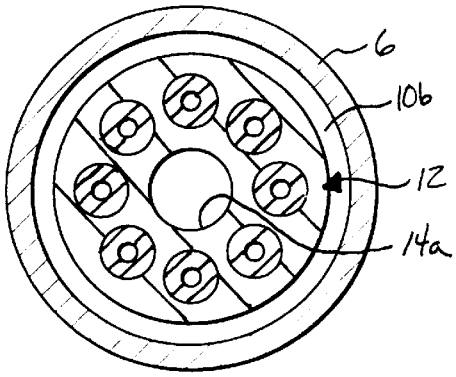
FIG. 2 is a cross-sectional view taken along a line 2—2 of FIG. 1.

Referring to FIGS. 1 and 2, the reference numeral 2 refers to a borehole formed in the ground and penetrating an oil and gas reservoir 4. A cylindrical casing 6 lines the borehole 2, and multiple perforations 6*a* are formed in the casing to allow production fluid to flow from the reservoir 4 into the casing for removal to the surface in a manner to be described. A packer 8 is disposed within the casing 6 and partitions the space defined by the casing 6 into chambers 10*a* and 10*b*.

A plurality of valves 12 are disposed within the casing chamber 10*b* and are mounted on a section of production tubing 14 that extends from the surface to an area in the casing in the vicinity of the reservoir 4. To this end, a plurality of angularly-spaced slots are formed in the tubing 14 that respectively receive a portion of each valve 12. Each valve 12 has a passage 12*a* extending therethrough and communicating at one end with the chamber 10*b* and at the other end with the interior 14*a* of the tubing 14. A valve 12 will be described in detail later.

A flatpack 15, in the form of an umbilical, extends from the surface, down the borehole 2 between the casing 6 and the tubing 14 and is connected to each valve 12. The flatpack 15 is connected to a controller (not shown) at the surface and contains electrical lines, hydraulic lines, and communication conductors for conducting signals from the controller to selectively open and close the valves to respectively permit and prevent the flow of fluid therethrough, in a manner to be described. In this context, each valve 12 can be opened and closed by the controller, via the flatpack 15, independently of the operation of the other valves in a manner to be described.

In operation, production fluid flows into the casing 6 through the multiple perforations 6*a*, and enters the casing chamber 10*b*. When a valve 12 is in its open position, it allows production fluid to flow from the casing chamber 10*b*, through the passage 12*a* in the valve, and to the interior 14*a* of the tubing 14 for passage through the tubing to the surface for recovery.

Figure 3:
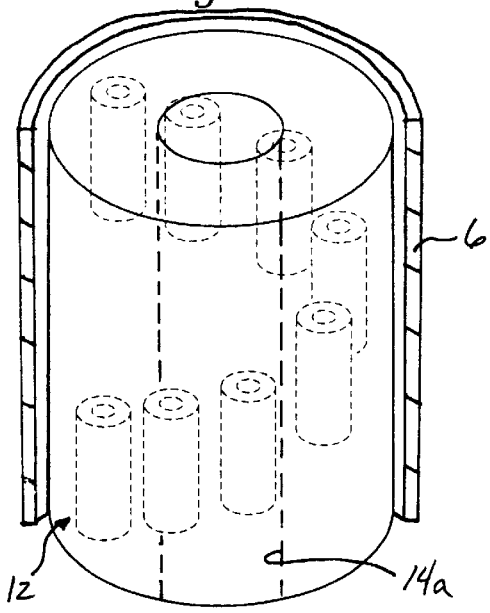
FIG. 3 is a perspective view, partially in section, depicting an alternate disposition of the valves of FIGS. 1 and 2.

Referring to FIG. 3, an alternative arrangement of the valves 12 relative to the tubing 14 is shown. According to this arrangement the valves 12 are angularly and axially spaced relative to the tubing 14. Otherwise, the arrangement of FIG. 3 is identical to that of FIGS. 1 and 2. This valve arrangement permits a relatively large number of valves to be utilized, and the individual valves 12 may be wider, and yet still fit within the relatively narrow confines of the casing 6.

Figure 4:
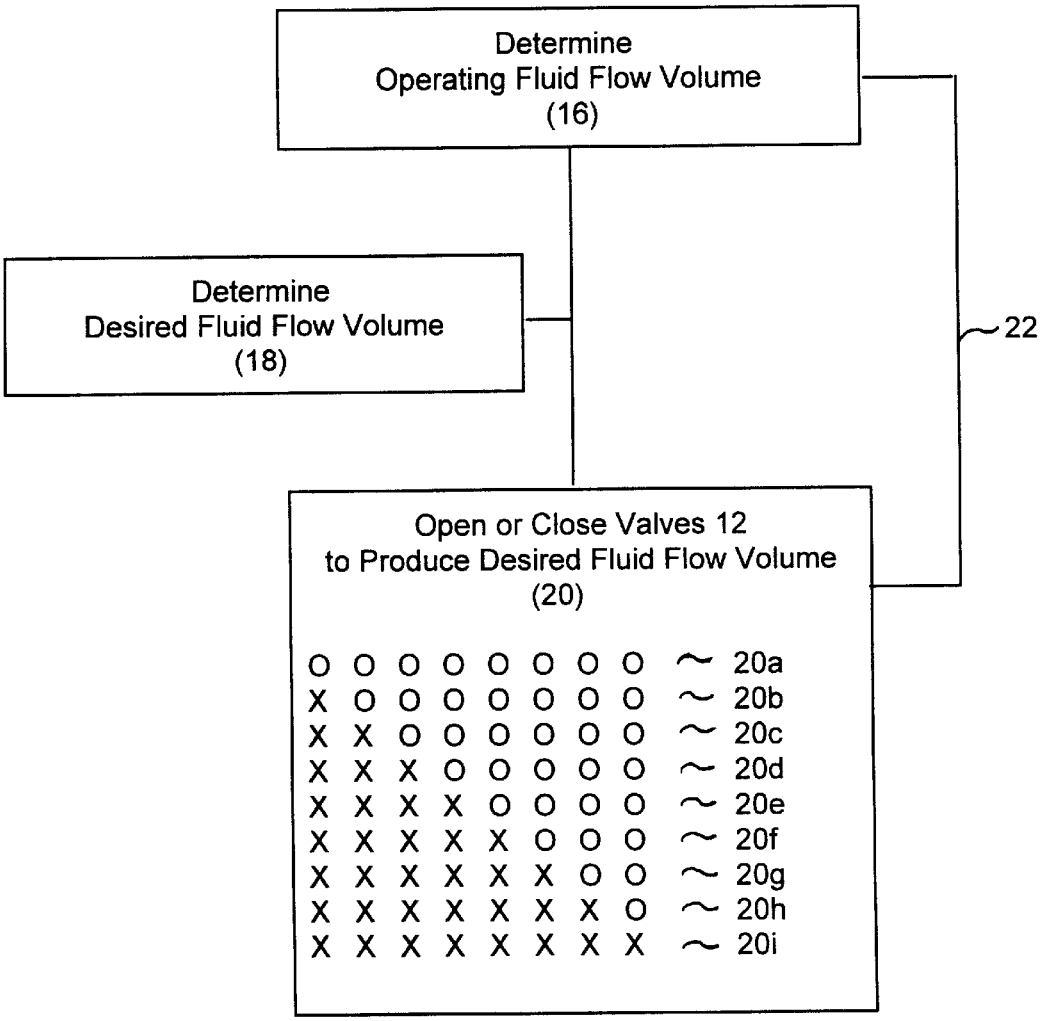
FIG. 4 is a schematic view of the multi-valve fluid flow control system.

FIG. 4 depicts a series of steps for controlling the volume of production fluid ("operating production fluid flow volume") delivered by the production tubing 14 to the surface using either the valve arrangement of FIGS. 1 and 2 or that of FIG. 3. More particularly, the operating production fluid flow volume is initially determined in step 16 and, in step 18, the desired production fluid flow volume for maximizing the production from the reservoir 4 is determined. In step 20, the desired production fluid flow volume (determined in step 18) is attained by the above-mentioned controller logically opening or closing each of a series of eight valves, each of which is depicted by either an "O" (denoting that the valve is in the open position) or an "X" (denoting that the valve is in the closed position) extending horizontally in the step 20 box. For example, in the first alternate flow volume step 20*a*, all the valves are depicted as open ("O"). The operating production fluid flow volume may be incrementally adjusted by closing ("X") one valve 12, as in the step 20*b*. The system can further be incrementally adjusted by closing additional valves 12 to attain different flow volume steps 20*c*, 20*d*, 20*e*, 20*f*, 20*g*, 20*h*, until all the valves are closed as in step 20*i*, which represents zero flow volume. A feedback loop 22 to step 16 allows for determination of the new operating production fluid flow volume and subsequent comparison between it and the desired production fluid flow volume from step 18, which may require the opening or closing of more of the valves 12.

It is thus seen that the system of the above embodiment provides incremental control over the amount of fluid flow, yet is simple, inexpensive, and relatively small in size, while requiring minimal electrical power.

Figure 5:
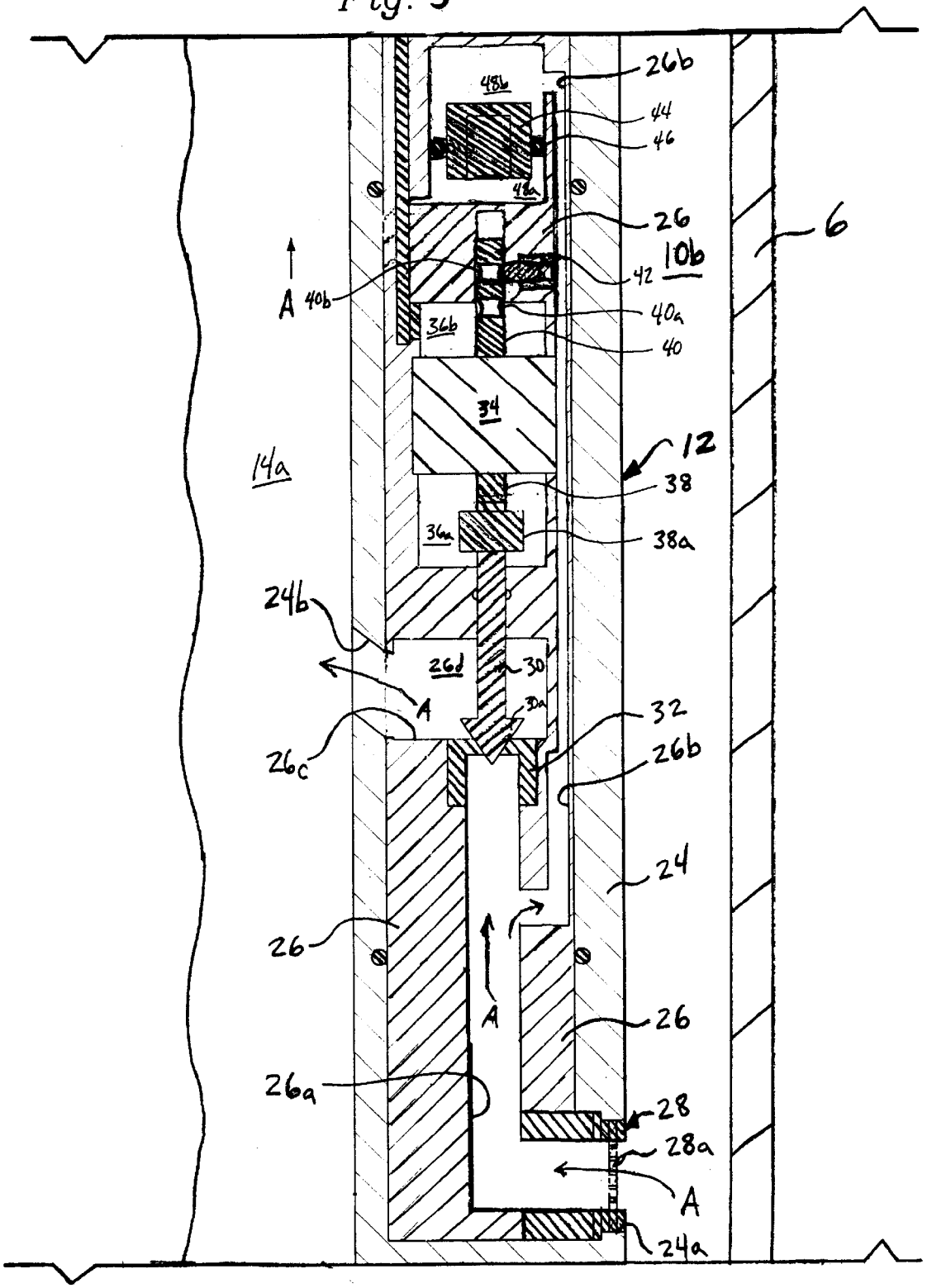
FIG. 5 is a sectional view of a first embodiment of a valve of the system of FIGS. 1–4.

The valve 12 shown on the right side of the tubing 14, as viewed in FIG. 1, is shown in detail in FIG. 5. The valve 12 includes a cylindrical housing 24, a portion of which is disposed in a corresponding opening formed in the wall of the tubing 14 (not shown in FIG. 5). The housing 24 has a radially extending inlet 24*a* formed in the lower portion thereof, as viewed in FIG. 5, and a radially extending outlet 24*b* spaced from the inlet and formed through an diametrically-opposed wall of the housing.

An insert 26 is disposed in the housing 24, and is in the form of a solid cylindrical having various chambers and passages formed therethrough. More particularly, an axial bore 26*a* is formed in the lower portion of the housing with its lower end communicating with the inlet 24*a*. A passage 26*b* extends parallel to, and communicates with, the bore 26*a*. A radial bore 26*c* is also formed in the insert 26 and connects the bore 26*a* and the outlet 24*b*.

A nozzle 28 is removably disposed in the inlet 24*a*, and a screen 28*a* is disposed in the nozzle 28 to prevent particles of a predetermined size from entering the valve 12.

A piston 30 is slidably disposed in the insert 26 with a portion extending into the bore 26*c*. A tapered head 30*a* is disposed on one end of the piston 30, and a seat 32 is disposed in the insert 26 at the upper end of the bore 26*a* for receiving the head 30*a* of the piston. The valve 12 is in its closed position when the piston head 30*a* engages the seat 32, as shown, to prevent fluid flow through the bore 26*a*. The piston 30, and therefore the head 30*a*, are adapted to move upwardly to a spaced position from the seat 32 to permit fluid flow, under conditions to be described.

A bidirectional solenoid 34 is disposed in the insert 26 for controlling the movement of the piston 30 and extends between two chambers 36*a* and 36*b* which receive a pressure compensation fluid for reasons to be described.

A rod 38 extends from one end of the solenoid 34 and into the chamber 36*a* and is connected to the other end of the piston 30 by an adapter, or connector, 38*a*. A second rod 40 extends from the solenoid 34 in the opposite direction, through the chamber 36*b* and into an opening formed in the insert 26. The rod 40 has a pair of grooves, 40*a* and 40*b*, and is operably connected to the rod 38 in the interior of the solenoid 34.

A detente 42 is disposed in a radial opening in the insert 26 and is forced by a spring, or the like (not shown) radially inwardly into engagement with the grooves 40*a* and 40*b* of the rod 40. The detente 42 engages the groove 40*b* when the piston 30 is in its closed position as shown, and engages the groove 40*a* when the piston is in its open position, as will be described.

A floating compensation piston 44 is slidably disposed in the insert 26 above the upper end of the rod 40. A seal ring 46 surrounds the piston 44 and engages the corresponding surface of the insert 26 to define two chambers 48*a* and 48*b*. The chamber 48*a* extends between the lower surface of the piston 44 and a solid portion of the insert 26 and is filled with pressure compensation fluid. Although not shown in the cross section of the drawings, it is understood that the chamber 48*a* communicates with chambers 36*a* and 36*b* to form a closed system. The chamber 48*b* communicates with the upper end of the passage 26*b* so that the fluid pressure at the inlet 24*a* is transferred through the bore 26*a* and the passage 26*b*, and to the chamber 48*b*.

The flatpack 15 (FIG. 1) electrically connects the above-mention controller on the surface to the solenoid 34 to transmit electrical signals from the controller to the solenoid to move the piston 30 between its opened and closed positions relative to the seat 32, as described above. When the groove 40*b* of the rod 40 is engaged by the detente 42 to retain the piston 30 in its closed position, the fluid pressure at the inlet 24*a* is relatively high and is transmitted, via the chamber 26*b*, to the chamber 48*b*. This, in turn, forces the piston 44 downwardly to cause a corresponding increase in the pressure of the compensation fluid in the chamber 48*a* and therefore in the chambers 36*b* and 36*a*, thus equalizing the forces on the piston 44.

The valve 12 is opened by a corresponding signal from the above-mentioned controller transmitted by the flatpack 15 (FIG. 1) to the solenoid 34 to activate the solenoid which functions to move the piston 30 upwardly as viewed in FIG. 1 so that the head 30*a* extends above the seat 32. When the piston 30 moves upwardly a predetermined distance, the detente 42 engages the groove 40*a* of the rod 40 and thus holds the piston 30 in the open position. Fluid thus flows from inlet 24*a*, through the bore 26*a* and the opening in the seat 32 and discharges from the bore 26*c* and the outlet 24*b*. The fluid pressure at the inlet 24*a* thus decreases, causing a corresponding decrease in the fluid pressure in the chamber 48*b*. Thus, the relatively high-pressure fluid in the chambers 48*a*, 36*b*, and 36*a* acts against the compensation piston 44 to force it upwardly as viewed in FIG. 5 and equalize the forces on the piston. The solenoid 34, when activated as described above, exerts a force sufficient to overcome the engagement of the groove 40*a* or 40*b* by the detente 42 when the solenoid is activated to move the piston 30 to a new selected position.

It is understood that many, if not all, of the above components, with the exception of the seal rings, can be constructed of an erosion-resistant material, such as tungsten carbide, to withstand the heat, pressure, and particles associated with reservoir depths.

There are several advantages to the above. For example, the piston 30 is electrically driven by actuation of the solenoid 34, yet utilizes a hydraulic fluid assist to maintain the piston in its open and closed position. Also, the engagement of the detente 42 with either the groove 40*a* or 40*b* restrains the piston 30 in the selected position, and thereby reduces the electrical energy required by the solenoid 34 to keep the piston in the selected position. Further, the piston 44 functions to equalize pressure variations caused by the opening and closing the valve 12 and by temperature changes between the surface and the downhole location of the valve 12, thus decreasing the energy required by the solenoid 34 to move the piston 30. Also, the nozzle 28 can be replaced with a nozzle having a different inlet diameter to further adjust the production fluid flow volume and pressure accordingly.

Figure 6:
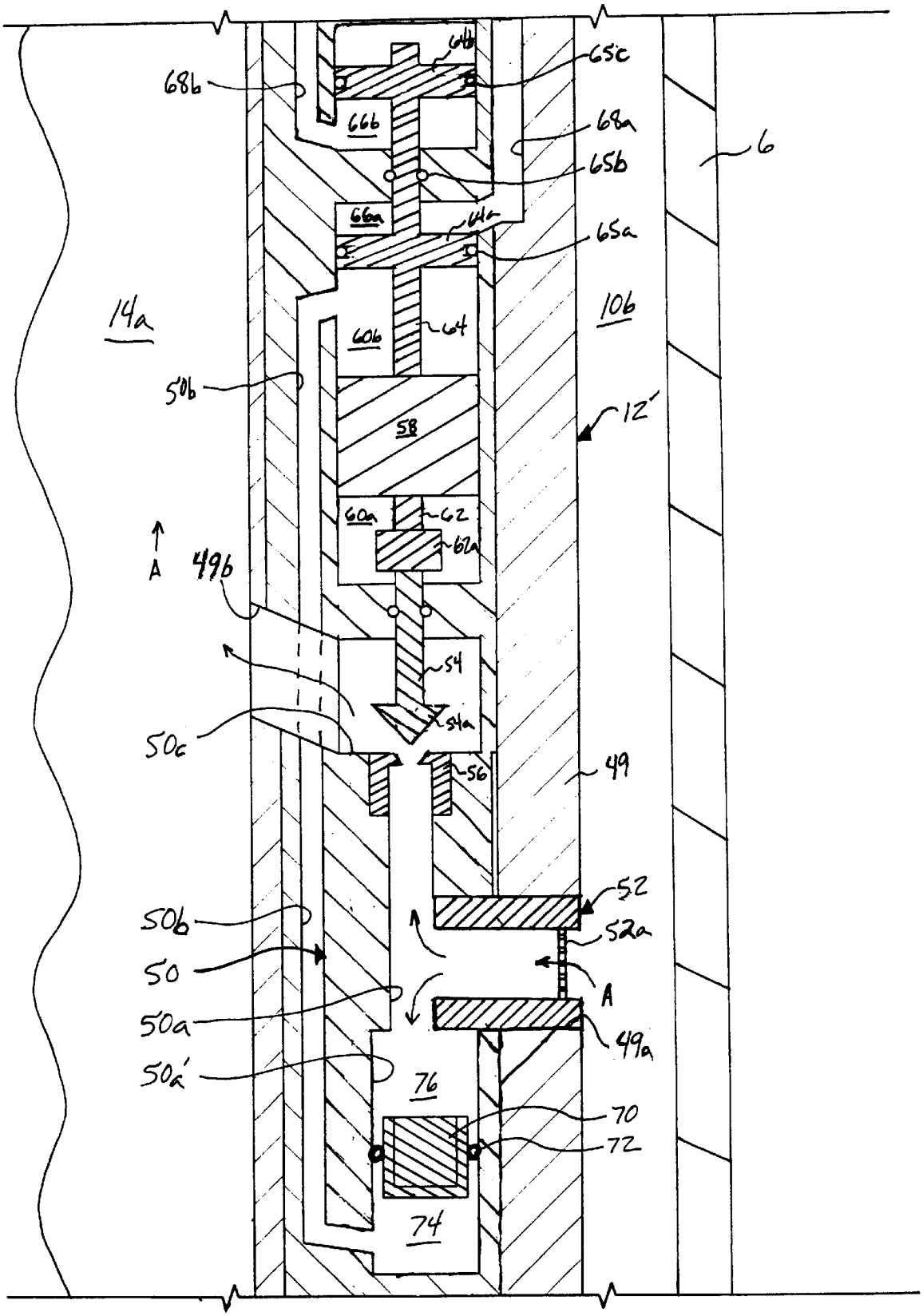
FIG. 6 is a sectional view of a second embodiment of a valve of the system of FIGS. 1–4.

FIG. 6 depicts an alternate embodiment of the valve 12, generally referred to by the reference numeral 12' which is located in the tubing 14 in the same manner as the valve 12. The valve 12' includes a cylindrical housing 49 having a radially extending inlet 49*a* communicating with the chamber 10*b* and a radially extending outlet 49*b* spaced from the inlet and communicating with interior 14*a* of the tubing 14.

An insert 50 is disposed in the housing 49, and has a stepped axial bore 50*a* formed in the lower portion thereof as viewed in FIG. 6 and in communication with the inlet 49*a*. A passage 50*b* is formed in the insert 50 and extends parallel to, but isolated from, the bore 50*a*, as will be explained. The insert 50 also has a radial bore 50*c* which connects the bore 50*a* and the housing outlet 49*b*.

A nozzle 52 is removably disposed in the inlet 49*a*, and a screen 52*a*, is disposed in the opening of the nozzle 52 to prevent particles of a predetermined size from entering the valve 12'.

A piston 54 is slidably disposed in the insert 50 with a portion extending into the bore 50*c*. A tapered head 54*a* is disposed on one end of the piston, and a seat 56 is disposed in the insert 50 at the other end of the bore 50*a* for receiving the head 54*a* of the piston. The valve 12' is in its closed position when the piston head 54*a* engages the seat 56 to prevent fluid flow through the bore 50*a*. The piston 54, and therefore the head 54*a*, are adapted to move upwardly, as viewed in FIG. 6 to an open position in which the head is spaced from the seat 56, as shown, to permit fluid flow, under conditions to be described.

A bidirectional solenoid 58 is provided for controlling the movement of the piston 54 and is disposed between two chambers 60*a* and 60*b*. Both chambers 60*a* and 60*b* receive a pressure compensation fluid, and the chamber 60*b* is connected to the passage 50*b*, as will be explained.

A rod 62 extends from the lower end of the solenoid 58 as viewed in FIG. 6, into the chamber 60*a*, and is connected to the other end of the piston 54 by a connector, or adapter 62*a*.

A hydraulic piston 64 is slidably disposed in the insert 50 above the upper end of the solenoid 58, and has a circular flange 64*a* formed thereon which engages the corresponding surface of the insert 50, via a sealing ring 65*a*, to define the chamber 60*b* between it and the upper surface of the solenoid. The lower end of the piston 64 is operably connected to the rod 62 in the interior of the solenoid 58, and therefore to the piston 54.

A chamber 66*a* is defined between the upper surface of the flange 64*a* and a corresponding surface of the insert 50. The chamber 66*a* communicates with a hydraulic passage 68*a* formed in the insert 50 which receives hydraulic fluid from a line included in the flatpack 15 (FIG. 1) and passes the fluid to the chamber 66*a*.

An additional circular flange 64*b* is formed on the piston 64 in a spaced relation to the flange 64*a*. That portion of the piston 64 extending between the flanges 64*a* and 64*b* slides in a corresponding opening in the insert 50 with a ring seal 65*b* disposed therebetween. The outer surface of the flange 64*b* engages a corresponding surface of the insert 50 defining the chamber 66*b*, via a sealing ring 65*c*. The chamber 66*b* is connected to a hydraulic passage 68*b* which receives hydraulic fluid from a line included in the flatpack 15 (FIG. 1) and passes the fluid to the chamber 66*b*.

A pressure compensation piston 70 is slidably mounted in the lower portion of the bore 50*a*. An O-ring 72 surrounds the piston 70, and engages the corresponding surface of the bore 50*a*, to partition the bore into chambers 74 and 76. The chamber 74 contains a pressure compensation fluid and is connected to the chambers 60*a* and 60*b* by a passage 50*b* to form a closed system. The chamber 76 communicates with the inlet 49*a* and thus receives the production fluid pressure at the inlet.

To open the valve 12', the solenoid 58 is actuated to move the piston 54 to its open position in which the head 54*a* of the piston is spaced from the seat 56 as shown in FIG. 6. Also, the hydraulic line associated with the passage 68*b* is actuated so that hydraulic fluid passes into, and builds up in, the chamber 66*b* to apply an upwardly-directed force on the flange 64*b* and the piston 64, and therefore the piston 54, to maintain it in its open position. Production fluid flows from the casing chamber 10*b* through the nozzle 52 and the inlet 49*a*, in a direction indicated by the reference arrow A. The fluid flows through the seat 56, past the piston 54, through the bore 50*c*, and out of the outlet 49*b* to the interior of the tubing 14*a* for passing through the tubing 14 to the surface. The inlet pressure in chamber 76 decreases, allowing the compensation production fluid pressure in the chambers 74, 60*b*, and 60*a* to act against the piston 70, which moves accordingly to equalize the compensation pressure with the inlet pressure.

The valve 12' is closed in response to a signal generated at the controller and carried by the flatpack 15 from the controller to the solenoid. When this occurs, the solenoid 58 urges the rod 62, and therefore the piston 54, downwardly as viewed in FIG. 6, until the head 54*a* engages seat 56, thus closing the valve 12'. The hydraulic line carried in the flatpack 15 and associated with the passage 68*a* is actuated so that hydraulic fluid passes into, and builds up in, the chamber 66*a* to apply an downwardly-directed force on the flange 64*a* and the piston 64, and therefore the piston 54, to maintain it in its closed position.

This downward movement of the flange 64*a* thus reduces the volume of chamber 60*b*, thereby increasing the pressure throughout the compensation chambers 60*a*, 60*b*, and 74 which would normally result in upward movement of the compensation piston 70. However this pressure increase of the compensation fluid is counteracted by the inlet pressure, which increases in response to the closing of the piston 54 with the seat 56. Thus, the embodiment of FIG. 6 enjoys all the advantages of the embodiment of FIG. 5 while utilizing alternate designs to provide the hydraulic assist and to equalize the pressure variations caused by the opening and closing the valve 12 and by temperature changes between the surface and the downhole location of the valve 12.

Figure 8:
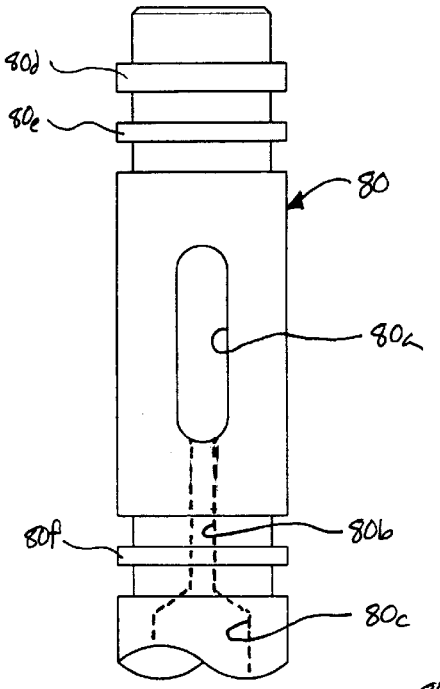
FIG. 8 is a perspective view of a valve member of the valve of the embodiment of FIG. 7.
Figure 7:
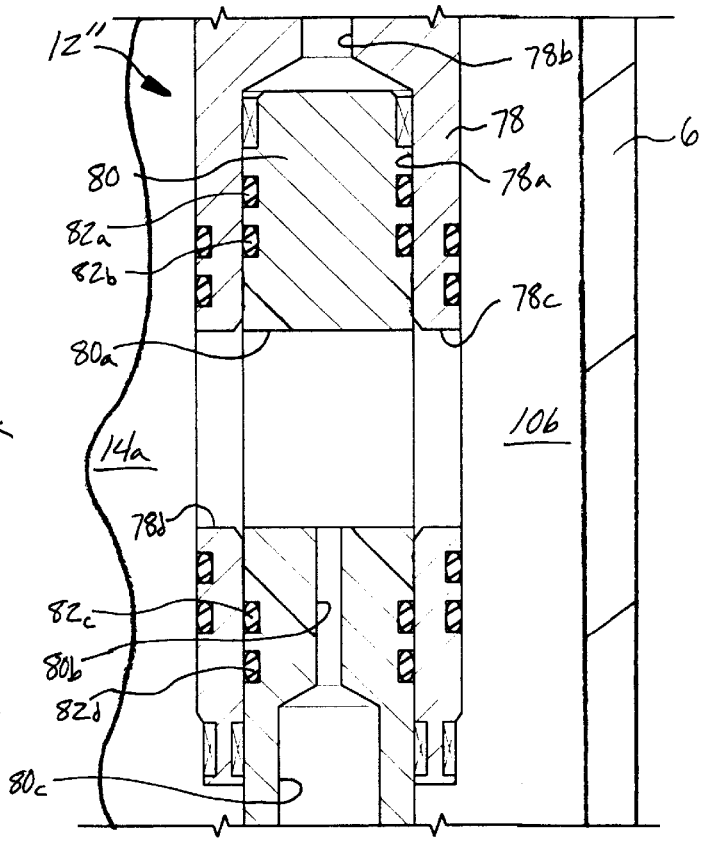
FIG. 7 is a sectional view of a third embodiment of a valve of the system of FIGS. 1–4.

Referring to FIGS. 7 and 8, another alternate embodiment of the valve is generally referred to by the reference numeral 12" which would be located in the tubing 14 in the same manner as the valves 12 and 12'. The valve 12" includes a cylindrical housing 78 having an axial bore 78*a* extending for substantially the entire length thereof, and an axial bore 78*b* in the upper portion of the housing 78 as viewed in FIG. 7 which has a relatively small diameter and which is tapered outwardly to communicate with the first axial bore 78*a*. A slot 78*c* extends radially through a wall of the housing 78 in communication with the casing chamber 10*b*, and a slot 78*d* extends though an opposed wall portion of the housing 78 in communication with the interior 14*a* of the tubing 14.

A tubular valve member 80 is disposed in the axial bore 78*a* of the housing 78 and has a through slot 80*a*, which extends radially through the member. The housing 78 is rotatable relative to the valve member 80 so that, when the slots 78*c* and 78*d* of the housing align with the slot 80*a* of the valve member 80, production fluid can flow from the casing chamber 10*b* to the interior of the tubing 14 with the amount of fluid flow depending on the degree of alignment of the slots, as well as the number of open valves.

The valve member 80 has a first axial bore 80*b* extending through a portion of the length thereof extending below the slot 80*a*. Another axial bore 80*c* is provided in the lower end portion of the valve member 80 and has a first portion of a larger diameter than that of the bore 80*b* and an inwardly-tapered portion which communicates with the latter bore.

As shown in FIG. 7, four axially-spaced seal rings 82*a*, 82*b*, 82*c*, and 82*d* extend in annular grooves formed in the outer surface of the valve member 80 and respectively engage corresponding surfaces of that portion of the housing 78 defining the bore 78*a*, to provide a fluid seal.

It is understood that the housing 78 is rotatable relative to the valve member 80 in any known manner such as by a rotating solenoid or a direct current (DC) brush-less motor that is operatively connected to the housing.

In operation, and assuming that the valve member 80 is in its closed position in which the slot 80*a* is not aligned with the slots 78*c* and 78*d* of the housing 78, thus blocking the flow of the production fluid through the valve 12", the aforementioned solenoid is actuated in response to a signal carried by the flatpack 15 (FIG. 1) from the above-mentioned controller (not shown). The solenoid functions to rotate the above-mentioned housing 78 until the housing slots 78*c* and 78*d* align with the slot 80*a* of the valve member 80 as shown in FIG. 7. Production fluid thus can flow from the casing chamber 10*b* through the aligned slots 78*c*, 80*a* and 78*d* and into the interior 14*a* of the tubing 14 for flow to the surface. It is noted that the amount of fluid flow through the valve 12" can be regulated by varying the degree of alignment of the slots 78*d* and 78*d* with the slot 80*a*.

If it is desired to close the valve 12" the solenoid is actuated again thus causing the housing 78 to rotate until the slot 78*c* and 78*d* move out of alignment with the slot 80*a* thus preventing the flow of the production fluid through the valve.

It is understood that production fluid or hydraulic fluid from a line included in the flatpack 15 could be introduced into the bore 78*b* and/or the bore 80*c* to minimize any pressure drop across the valve member 80 to maintain its axial alignment relative to the housing 78.

An advantage of the embodiment of FIGS. 7 and 8 is that the overall size of the valve 12" is reduced. Also, the production fluid flow can be controlled and varied in smaller increments, thus optimizing the reservoir production fluid output.

It is understood that, according to an alternate arrangement of the embodiment of FIGS. 7 and 8 the valve member 80 can be rotatable relative to the housing 78. In this case, a stem, or the like (not shown) would extend from one of the ends of the valve member 80 and through the bore 78*b* or the bores 80*b* and 80*c* and would be operatively connected to a corresponding solenoid or motor to rotate the stem, and therefore the valve member 80.

It is also understood that variations may be made to the foregoing without departing from the scope of the invention. For example, although reference is made to "lines" and "tubing" it is understood that conduits, pipes, hoses and any other type of fluid flow device could be used within the scope of the invention. Also, the spatial references, such as "upper" and "lower", "axial", "radial", etc. are for the purpose of illustration only and do not limit the specific orientation or location of the structure described above. Still further, the system and method of the present invention are not limited to a production fluid controlling system but are equally applicable to any fluid flow system.

It is understood that other variations, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A production fluid control system comprising a casing disposed in a downhole bore for receiving production fluid; tubing disposed in the casing with the outer surface of the tubing spaced from the inner surface of the casing to define an annular chamber for receiving the production fluid, the tubing having a plurality of openings formed in its walls; a plurality of valves respectively extending in the openings, each valve having a passage extending therethrough and communicating with the chamber and the interior of the tubing, each valve comprising a body member defining the passage and a valve member movable between a closed position relative to the passage to prevent any fluid flow through the passage and an open position to permit fluid flow from the chamber, through the passage, and into the interior of the tubing; a spring-loaded detente that is urged into engagement with the valve member in its open position and closed position to apply a force to the valve member to retain it in its open and closed position; and a control device for overcoming the force and moving the valve member from its open position to its closed position and from its closed position to its open position.

2. A production fluid control system comprising a casing disposed in a downhole bore for receiving production fluid; tubing disposed in the casing with the outer surface of the tubing spaced from the inner surface of the casing to define an annular chamber for receiving the production fluid, the tubing having a plurality of openings formed in its walls; a plurality of valves respectively extending in the openings, each valve having a passage extending therethrough and communicating with the chamber and the interior of the tubing, each valve comprising a body member defining the passage and a valve member movable between a closed position relative to the passage to prevent any fluid flow through the passage and an open position to permit fluid flow from the chamber, through the passage, and into the interior of the tubing; a retaining device for applying a force to the valve member to retain it in its open and closed position, wherein the retaining device comprises a flange disposed in a chamber in the body member and means for supplying hydraulic fluid to the chamber for forcing the flange, and therefore the valve member, to its closed position; and a control device for overcoming the force and moving the valve member from its open position to its closed position and from its closed position to its open position.

3. The system of claim 2 wherein the retaining device comprises another flange disposed in another chamber in the body member, and means for supplying hydraulic fluid to the latter chamber for forcing the other flange, and therefore the valve member to its open position.

4. A production fluid control system comprising a casing disposed in a downhole bore for receiving production fluid; tubing disposed in the casing with the outer surface of the tubing spaced from the inner surface of the casing to define an annular chamber for receiving the production fluid, the tubing having a plurality of openings formed in its walls; a plurality of valves respectively extending in the openings, each valve having a passage extending therethrough and communicating with the chamber and the interior of the tubing, each valve comprising a body member defining the passage and a valve member movable between a closed position relative to the passage to prevent any fluid flow through the passage and an open position to permit fluid flow from the chamber, through the passage, and into the interior of the tubing; a retaining device for applying a force to the valve member to retain it in its open and closed position; and an electrically actuated solenoid that overcomes the force and moves the valve member between its open and closed positions.

5. The system of claim 4 wherein the control device further comprises a controller to selectively apply electrical signals to the solenoids to selectively open and close the valve members.

6. The system of claim 5 wherein the controller controls the opening and closing of the valve members to control the amount of the fluid flow from the chamber to the interior of the tubing.

7. The system of claim 4 further comprising means for compensating for fluid pressure variations occurring in the body member in response to the valve member moving to its open and to its closed positions.

8. A method of controlling production fluid flow from a chamber extending between a casing disposed in a downhole bore and tubing disposed in the casing, comprising the steps of disposing a plurality of valves in respective openings formed in the tubing, connecting the chamber and the tubing interior with a passage formed through each of the valves, providing valve members for the passages for selectively closing the passages to prevent any fluid flow through the passage, and opening the passages to permit fluid flow from the chamber, through the passage, and into the interior of the tubing, urging a spring-loaded detente into engagement with the valve member to apply a first force to the valve member to retain it in its open position and its closed position, applying a second force to each valve member to retain it in its closed position; and overcoming the first force to enable the valve member to move from its open position to its closed position, and overcoming the second force to enable the valve member to move from its closed position to its open position.

9. The method of claim 8 wherein the second force is applied by hydraulic fluid pressure acting on the valve member.

10. The method of claim 8 wherein the each step of overcoming comprises the step of connecting a solenoid to the valve member and actuating the solenoid to move the valve member to its open and closed positions.

11. The method of claim 10 wherein the step of actuating is controlled to control the amount of the fluid flow from the chamber to the interior of the tubing.

12. The method of claim 8 further comprising the step of compensating for fluid pressure variations occurring in the body member in response to the valve member moving to its open and to its closed positions.

* * * * *